US006167625B1

(12) United States Patent
King et al.

(10) Patent No.: US 6,167,625 B1
(45) Date of Patent: Jan. 2, 2001

(54) SHAVING IMPLEMENT

(75) Inventors: Brian F. King, Orange; David C. Coffin, Milford; Michael P. O'Malley, Southport; Andrew J. Pennella, Stamford, all of CT (US)

(73) Assignee: Warner-Lambert Company, Morris Plains, NJ (US)

( * ) Notice: Under 35 U.S.C. 154(b), the term of this patent shall be extended for 0 days.

(21) Appl. No.: 09/313,588

(22) Filed: May 18, 1999

(51) Int. Cl.[7] ..... B26B 19/42

(52) U.S. Cl. ..... 30/34.2; 30/50; 30/77; 30/81; 30/82

(58) Field of Search ..... 30/34.2, 50, 77, 30/81, 82; D28/47

(56) References Cited

U.S. PATENT DOCUMENTS

| | | |
|---|---|---|
| D. 402,084 | 12/1998 | Chen et al. . |
| 811,999 | 2/1906 | Benet . |
| 1,618,895 | 2/1927 | Taplinger . |
| 1,797,150 | 3/1931 | Kaempfe . |
| 2,068,085 | 1/1937 | Stanley . |
| 2,129,064 | 9/1938 | Lewando . |
| 2,221,119 | 11/1940 | Starr . |
| 2,291,605 | 8/1942 | Bratter . |
| 2,300,794 | 11/1942 | Martin . |
| 2,374,612 | 4/1945 | Mellon . |
| 2,548,959 | 4/1951 | Eisenberg et al. . |
| 2,568,047 | 9/1951 | Anderson . |
| 2,670,534 | 3/1954 | Haber . |
| 2,710,446 | 6/1955 | Seko . |
| 2,718,694 | 9/1955 | Scully . |
| 2,766,521 | 10/1956 | Benvenuti . |
| 2,817,146 | 12/1957 | Roberts . |
| 2,852,845 | 9/1958 | Scully . |
| 3,116,550 | 1/1964 | De-Paoli . |
| 3,127,675 | 4/1964 | Kobler . |
| 3,127,676 | 4/1964 | Kaempfe . |
| 3,138,865 | 6/1964 | Meyer . |
| 3,417,468 | 12/1968 | Miyauchi . |
| 3,722,090 | 3/1973 | Dawidowicz . |
| 3,909,939 | 10/1975 | Dootson . |
| 4,044,120 | 8/1977 | Roswell et al. . |
| 4,189,832 | 2/1980 | Harper et al. . |
| 4,310,968 | 1/1982 | Buik et al. . |
| 4,624,051 | 11/1986 | Apprille, Jr. et al. . |
| 4,741,103 | 5/1988 | Hultman . |
| 4,807,360 | 2/1989 | Cerier et al. . |
| 4,850,106 | 7/1989 | Braun et al. . |
| 4,872,263 | 10/1989 | Etheredge, III . |
| 4,875,287 | 10/1989 | Creasy et al. . |
| 4,944,090 | 7/1990 | Sumnall . |
| 5,003,694 | 4/1991 | Chen . |
| 5,056,222 | * 10/1991 | Miller et al. ..... 30/77 |
| 5,072,512 | 12/1991 | Noujain . |

(List continued on next page.)

FOREIGN PATENT DOCUMENTS

| | | |
|---|---|---|
| 2737323 | 2/1978 | (DE) . |
| 3012690 | 10/1980 | (DE) . |
| 3049488 | 10/1981 | (DE) . |
| 3315635 | 12/1984 | (DE) . |
| 0254491 | 1/1988 | (EP) . |
| 254491 | 1/1988 | (EP) . |
| 306711 | 3/1989 | (EP) . |
| 416358 | 3/1991 | (EP) . |

(List continued on next page.)

*Primary Examiner*—Hwei-Siu Payer
(74) *Attorney, Agent, or Firm*—Charles W. Almer

(57) ABSTRACT

A shaving implement, such as a disposable cartridge or razor, comprises a shaving head which includes a skin-contacting element in the form of a series of cavities and projections. The projections are arranged in the cavities in order to provide a unique sensation to the user during shaving. The cavities are arranged so as to meter the amount of shaving cream which is on the surface being shaved.

32 Claims, 8 Drawing Sheets

U.S. PATENT DOCUMENTS

| | | | | |
|---|---|---|---|---|
| 5,092,042 | * | 3/1992 | Miller et al. | 30/77 |
| 5,095,619 | | 3/1992 | Davis et al. . | |
| 5,095,620 | | 3/1992 | Althaus . | |
| 5,113,585 | | 5/1992 | Rogers et al. . | |
| 5,141,694 | | 8/1992 | Butlin et al. . | |
| 5,168,628 | | 12/1992 | Mock et al. . | |
| 5,185,927 | | 2/1993 | Rivers . | |
| 5,191,712 | | 3/1993 | Crook et al. . | |
| 5,249,361 | | 10/1993 | Apprille, Jr. et al. . | |
| 5,345,680 | | 9/1994 | Vreeland . | |
| 5,349,750 | | 9/1994 | Tseng . | |
| 5,388,332 | | 2/1995 | Oldroyd . | |
| 5,416,973 | | 5/1995 | Brown et al. . | |
| 5,426,851 | | 6/1995 | Gilder et al. . | |
| 5,454,164 | | 10/1995 | Yin et al. . | |
| 5,524,356 | | 6/1996 | Backhaus . | |
| 5,551,152 | | 9/1996 | Tseng . | |
| 5,590,468 | | 1/1997 | Prochaska . | |
| 5,626,154 | | 5/1997 | Rogers et al. . | |
| 5,653,971 | | 8/1997 | Badin et al. . | |
| 5,689,883 | | 11/1997 | Ortiz et al. . | |
| 5,706,582 | | 1/1998 | Hosokawa et al. . | |
| 5,711,076 | | 1/1998 | Yin et al. . | |
| 5,713,131 | | 2/1998 | Rogers et al. . | |
| 5,781,997 | | 7/1998 | Ferraro et al. . | |
| 5,794,343 | * | 8/1998 | Lee et al. | 30/50 |
| 5,903,979 | * | 5/1999 | Oldroyd | 30/77 |
| 5,915,791 | | 6/1999 | Yin et al. . | |
| 5,953,819 | * | 9/1999 | Simms et al. | 30/34.2 |

FOREIGN PATENT DOCUMENTS

| | | |
|---|---|---|
| 453138 | 10/1991 | (EP) . |
| 563618 | 10/1993 | (EP) . |
| 2323502 | 4/1977 | (FR) . |
| 2024082 | 5/1979 | (GB) . |
| 1557177 | 12/1979 | (GB) . |
| 55-116383 | 9/1980 | (JP) . |
| 57-500415 | 3/1982 | (JP) . |
| 59-500258 | 2/1984 | (JP) . |
| 59-13875 | 4/1984 | (JP) . |
| 60-182987 | 9/1985 | (JP) . |
| 61-51910 | 11/1986 | (JP) . |
| 63-21247 | 6/1988 | (JP) . |
| 64-70090 | 3/1989 | (JP) . |
| 2-500338 | 2/1990 | (JP) . |
| 4-36972 | 3/1992 | (JP) . |
| 4-117988 | 4/1992 | (JP) . |
| 4-126182 | 4/1992 | (JP) . |
| 4-502413 | 5/1992 | (JP) . |
| 4-361782 | 12/1992 | (JP) . |
| 4-361783 | 12/1992 | (JP) . |
| 5-191 | 1/1993 | (JP) . |
| 5-192 | 1/1993 | (JP) . |
| 5-42264 | 2/1993 | (JP) . |
| 5-42266 | 2/1993 | (JP) . |
| 5-501515 | 3/1993 | (JP) . |
| 5-277264 | 10/1993 | (JP) . |
| 5496694 | 3/1994 | (JP) . |
| 8102864 | 10/1981 | (WO) . |
| 888776 | 4/1988 | (WO) . |
| 9205927 | 4/1992 | (WO) . |
| 9217322 | 10/1992 | (WO) . |
| 9220499 | 11/1992 | (WO) . |
| 9301918 | 2/1993 | (WO) . |
| 9323214 | 11/1993 | (WO) . |
| 9624469 | 8/1996 | (WO) . |
| 9955499 | 11/1999 | (WO) . |
| 9964210 | 12/1999 | (WO) . |

* cited by examiner

SHAVING IMPLEMENT

FIELD OF THE INVENTION

The present invention is directed to wet shaving systems, and in particular to shaving implements, such as disposable razors or cartridges, having one or more razor blade cutting edges disposed between a guard and a cap.

BACKGROUND OF THE INVENTION

In conventional wet shaving systems, a razor includes a handle and a shaving head. The shaving head, which may be either unitary with the handle or a separate, replaceable cartridge, houses one or more razor blades and includes a guard and cap on opposite sides of the blade cutting edge so as to maintain the blade edge at a predetermined spacing and angle relative to the skin.

The guard is disposed below the blade, forward of the blade cutting edge, to engage the skin prior to the blade. In addition to defining the shaving geometry as described above, the guard acts to pre-stretch the skin by a predetermined amount, so as to allow the blade to shave the skin closely and safely.

Normally, the skin-engaging surface of the guard is textured in some manner, for example to employ horizontal fins or ribs, such as disclosed in U.S. Pat. No. 3,939,560. Because the guard is normally part of the razor head or cartridge, the projections are metal or a hard plastic.

There have, however, been proposals to provide a guard which is a separate element from the shaving head, in order that the guard may be formed of an elastomeric material. For example, U.S. Pat. No. 2,548,959 discloses a metal razor having a guard element made out of rubber. The rubber guard elements are either mechanically attached to the head or glued to the metal guard.

There is currently on the market a razor cartridge which includes a resilient guard element in the form of a plurality of rows of flexible fins that extend parallel to the blade edge, as disclosed in U.S. Pat. No. 5,191,712 and U.S. Pat. No. 5,249,361. In the cartridge disclosed in the '361 patent, in order to attach the resilient guard element to the plastic cartridge body, the guard is formed of two parts, namely, a skin-engaging portion formed of an elastomeric material and a base portion of rigid plastic material. The rigid plastic base portion is provided with latch members so that the guard assembly can be snapped onto a blade cartridge body. There is also currently on the market a razor cartridge which includes a guard bar having a plurality of flexible, skin-engaging ridges which are in adjoining sections extending alternatively at positive and negative angles relative to the direction of shaving, as disclosed in U.S. Pat. No. 5,689,883.

It would be desirable to provide a shaving implement having a guard with a surface formed of flexible skin-engaging members to pre-stretch the skin prior to being shaved by the razor blade, which provides a very stable structure that can be mass produced in an economical and high quality manufacturing process, and which minimizes parts handling, feeding, and subassembly requirements normally required for a cartridge.

It would also be desirable to provide a row of skin-contacting members on the guard which pre-stretch the skin in an improved manner, provide a unique sensation to the user and deliver additional, previously undetected, consumer benefits related to close and comfortable shaving. It would also be advantageous to provide a row of cavities on the guard which would also enhance and sensation to the user as well as meter the correct amount of shaving cream onto the surface to be shaved.

SUMMARY OF THE INVENTION

A shaving implement such as a disposable razor or razor cartridge according to the invention comprises a shaving head which includes a cap portion, a guard portion, and at least one razor blade. The shaving head includes a skin-contacting element which is preferably formed of an elastomeric material which is insert molded into one or more recesses in the guard to extend across the shaving head.

The skin-contacting element includes a plurality of projections contained within a row of cavities. The projections and the cavities may be in the form of any desired shape, however preferably the projections and cavities are in the form of a geometric shape. While any geometric shape, including triangles, diamonds, squares or circles may be employed, most preferably both the projections and the cavities are in the geometric shape of a trapezoid. Further, a continuous line of the elastomeric material extends parallel and adjacent to the cutting edge of the blades. The geometric shape of the projections and cavities provide the benefit to the user of gradually increasing the tension on the skin as the skin approaches the blade or blades. In addition, the cavities hold and release a metered amount of shaving cream to the surface being shaved. The stretching of the skin prior to shaving is further enhanced by the continuous line of elastomeric material adjacent to the blades. The novel sensation experienced by the user may be controlled via the dimensions of the projections and cavity. For example, the projections may be the same length as, taller than, or shorter than the walls of the cavities. Also, the walls of the cavity may be tapered in either direction.

The present invention employs projections and cavities which preferably are as stiff as or stiffer than the fins used in the products which are currently on the market. The inventors have found that where flexible fins are perpendicular to the shaving direction and act like wiper blades to remove shaving cream and other lubrication prior to the blade shaving the skin, the posts and cavities meter the distribution of the shaving cream and leave a layer of lubricating material on the skin. Moreover, the different elements of the skin-contacting element provide a pleasant and comfortable shave.

The present invention has additional advantages when used in flexible razor cartridges. Such cartridges have a cartridge body which is flexible in a direction perpendicular to the blade, so that the blade can conform to the various contours of the face or other shaving surface. If a skin-contacting element having fins parallel to the blade edge were to be used in a flexible cartridge, the fins would act as stiffening ribs against flexing of the cartridge, thus interfering with its normal operation. In contrast, because of the cavities of the present invention, the skin-contacting element of the present invention is quite flexible in the normal flexing direction of the cartridge.

The recess in the guard for receiving the skin-contacting element may include, in addition to a seat portion, a joint forming portion for forming a mechanical joint, e.g., in a dovetail shape between the skin-contacting element and the guard. The skin-contacting element is insert molded onto the guard portion so as to fill the recess, such that the portion disposed in the dovetail portion forms a dovetail joint to help secure the skin-contacting element in place.

The guard supporting the skin-contacting element may be a plurality of guard segments, arranged parallel to the seat blade edge and having gaps therebetween. In this case, each guard segment is supported by a rib that extends forwardly from a respective rigid seat segment, and is provided with a recess for securing the skin-contacting element.

The skin-contacting element may comprise a plurality of segments secured to individual guard segments. However, as discussed above where the skin-contacting element is elastomeric, it is very flexible due to the cavities, and therefore the skin-contacting element need not be a plurality of segments and may advantageously extend continuously across the shaving head as a continuous element. A skin-contacting element may be secured to the cap as well, either as an alternative or in addition thereto.

For a better understanding of the invention, reference is made to the following detailed description of preferred embodiments, taken in conjunction with the drawings accompanying the application.

DETAILED DESCRIPTION OF THE PREFERRED EMBODIMENTS

Figure 1:
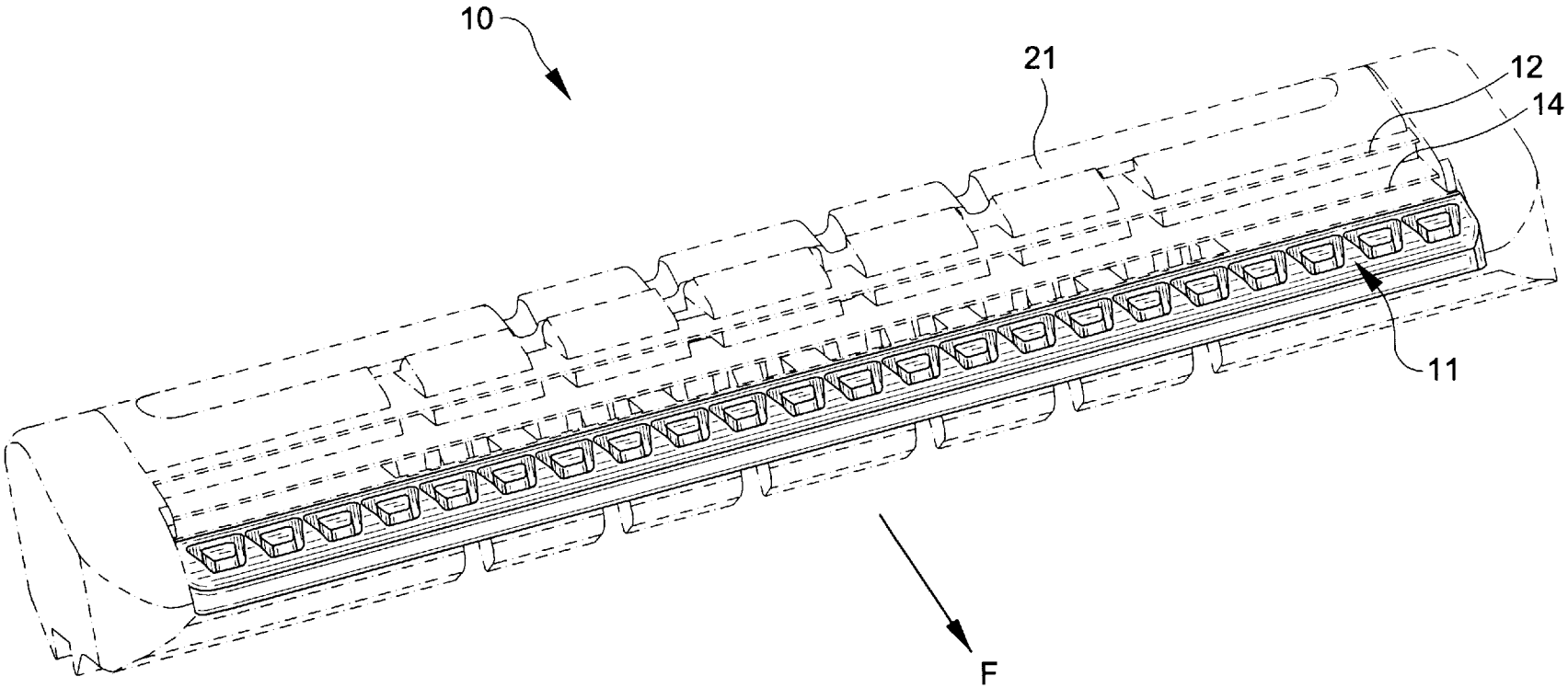
FIG. 1 is a perspective view of a razor cartridge having the skin-contacting element of the present invention.
Figure 2:
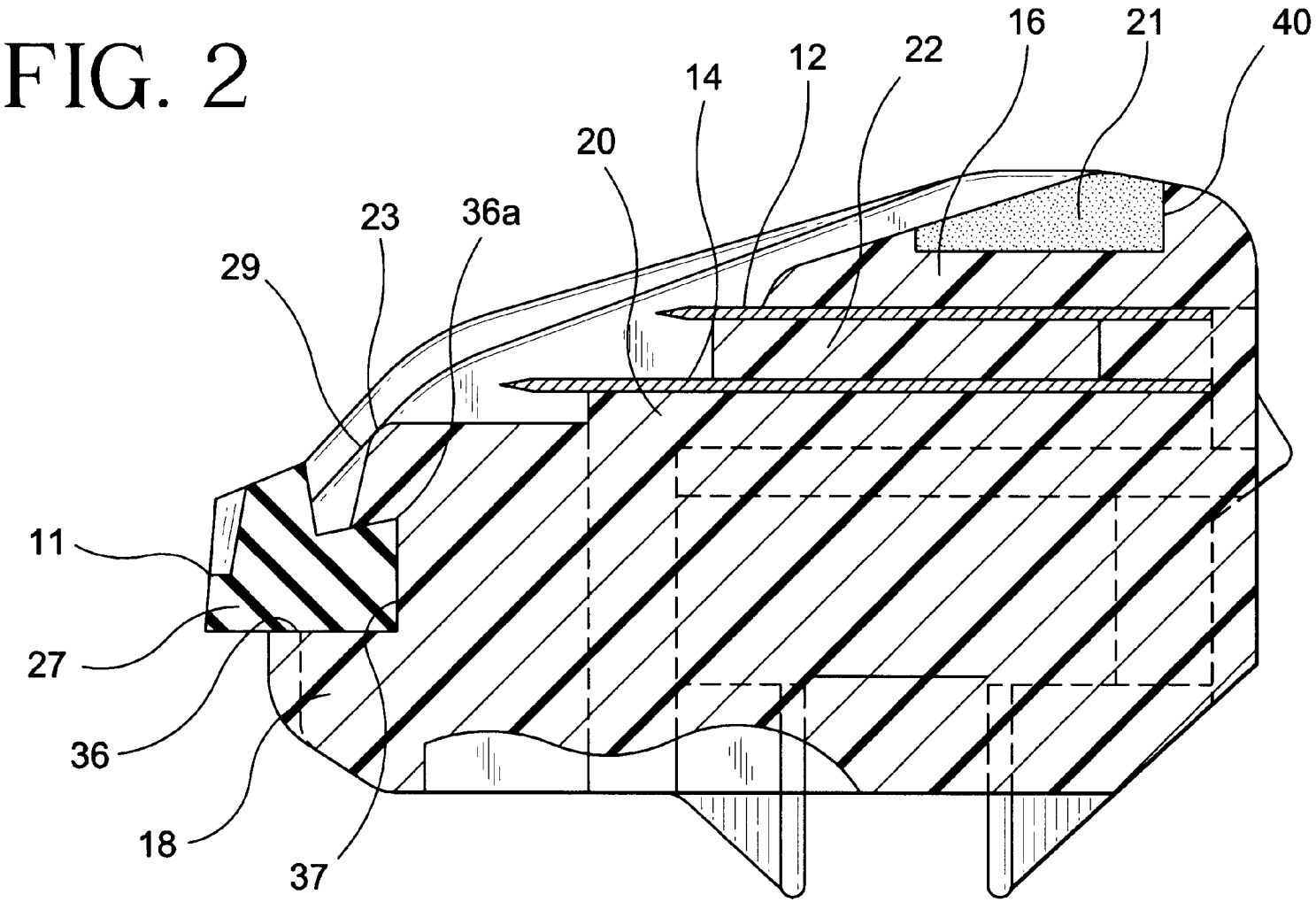
FIG. 2 is an enlarged, sectional view of the skin-contacting element of FIG. 1.
Figure 3:
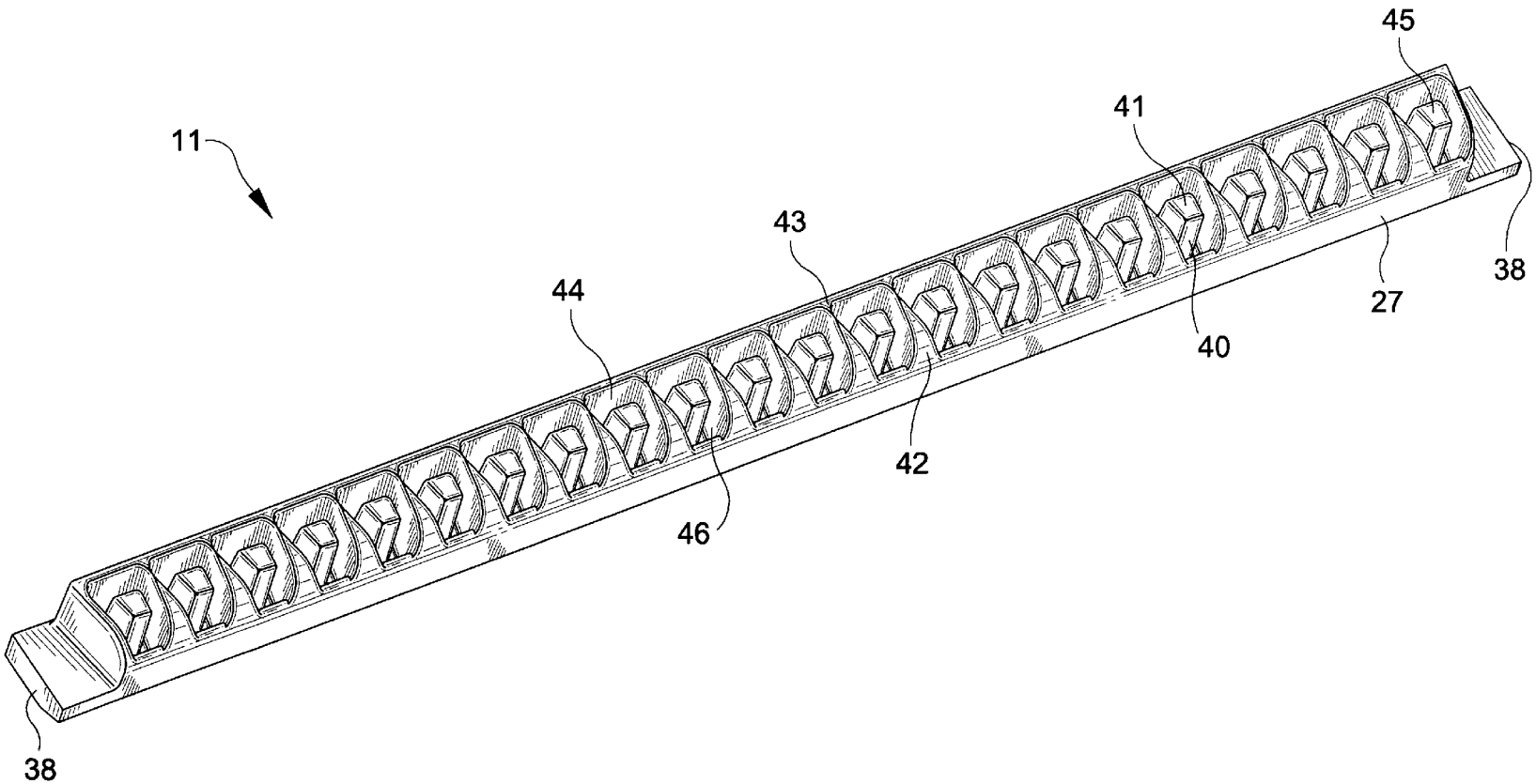
FIG. 3 is a perspective view of the skin-contacting element of the present invention.
Figure 4:
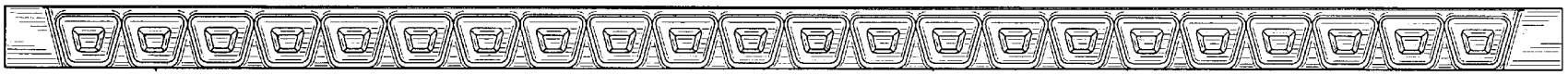
FIG. 4 is a top view of the skin-contacting element of the present invention.
Figure 5:
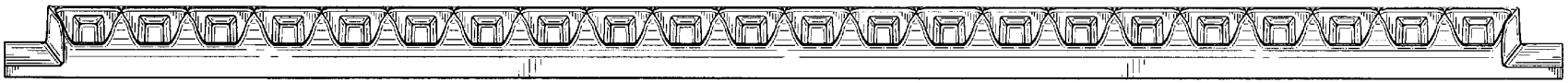
FIG. 5 is a front view of the skin-contacting element of the present invention.

The razor cartridge having the skin-engaging member of the present invention may be formed by numerous methods. Further, the skin-engaging member of the present invention may be utilized in either a disposable razor, which is a razor handle with an integral razor cartridge which is used for a certain number of shaves and then disposed in its entirety, or on a permanent razor system, in which the razor cartridge is replaced and the razor handle is reused. One method for manufacturing razors is insert molding. FIGS. 1 and 2 illustrate an insert molded razor cartridge 10 including a pair of single edge razor blades 12,14, a cap 16, and a guard 18. The lower blade, or seat blade 14, is supported on seat 20 whereas the upper blade, or cap blade, is spaced above the seat blade by a one or more spacer elements 22. In a preferred razor cartridge, the cap is molded as a plurality of segments, having gaps therebetween, to facilitate flexing of the cartridge 10, and includes a shaving aid 21, further described below. Examples of razor systems which employ a flexible blade cartridge are disclosed in Cartwright et al. U.S. Pat. No. Re. 30,913, Motta et al. U.S. Pat. No. 4,443,939, and Butlin U.S. Pat. No. 5,141,694, and need not be described further here. Such razor systems allow the blade to follow the contours of the skin when shaving and provide a better shave. While two blades are used for illustrative purposes, the skin-engaging member of the present invention may be utilized on razor cartridges having one, two, three or more blades.

In accordance with generally known insert molding processes, the blades 12, 14 are positioned in a cartridge forming mold, and plastic, preferably polypropylene, is injected to form seat 20, cap 16, spacers 22, and guard 18 and, in doing so, secure the blades as shown. The guard 18 is molded so as to form the recess 29 extending across the front surface of guard 18, including a horizontal ledge 36, a vertically extending rear wall 37, and a top ledge 36*a*, such that the recess 29 is partially inset into the guard 18 as shown in FIG. 2. Insert molding to form razor cartridges per se is generally known and therefore need not be described in detail here. For an example of a suitable insert molding process, see U.S. Pat. No. 5,141,694. After the cartridge unit has been thus molded, the skin-contacting element 11 is insert molded so as to fill the recess 29.

The guard 18 includes the skin-contacting element 11 which includes a base 27, a row of cavities and projections, a front wall 25 and a back wall 43. The guard 18 includes a recess 29 for receiving the base 27 so that the cavities and projections project from the guard 18 and form a skin-contacting surface. The guard is affixed to the razor cartridge in a similar manner as that of U.S. Pat. No. 5,689,883, and the disclosure of that patent is incorporated herein by reference. Further, the guard may be either a single unitary piece or separate segments, as also set forth in U.S. Pat. No. 5,689,883.

The guard portion 18 includes an outermost guard surface 23 lying generally along a tangent between the cap portion 16 and the resilient skin-contacting element 11. The guard surface limits the degree to which the razor can be pressed into the skin to protect the skin from cuts and nicks. However, if, as in the preferred embodiment, a skin-contacting element 11 is formed across the guard 18, it is not necessary to provide a guard surface 46 because the skin-contacting element will aid in performing the protective function. Preferably, the skin-contacting element 11 is formed of an elastomeric material which will chemically bond with the surfaces forming the recess 29 in the guard 18. In the guard 18 shown in FIG. 2, the recess 29 is partially inset into the guard 18 so as to have three surfaces (opposed horizontal top ledge 36*a*, bottom ledge 36, and vertical back wall 37) to secure the base 27 of the skin-contacting element 11. The preferred materials for the skin-contacting element, where the guard 18 is made of polypropylene, are a thermoplastic rubber such as Hercuprene 1000, 3000 series, Durometer 30 to 90 A scale; Kraton G series, Durometer 30 to 90 A scale; and Santoprene 2271 series, Durometer 30 to 90 A scale. Most preferably, a thermoplastic rubber, having a durometer of 45 Shore A scale is used.

Figure 6:
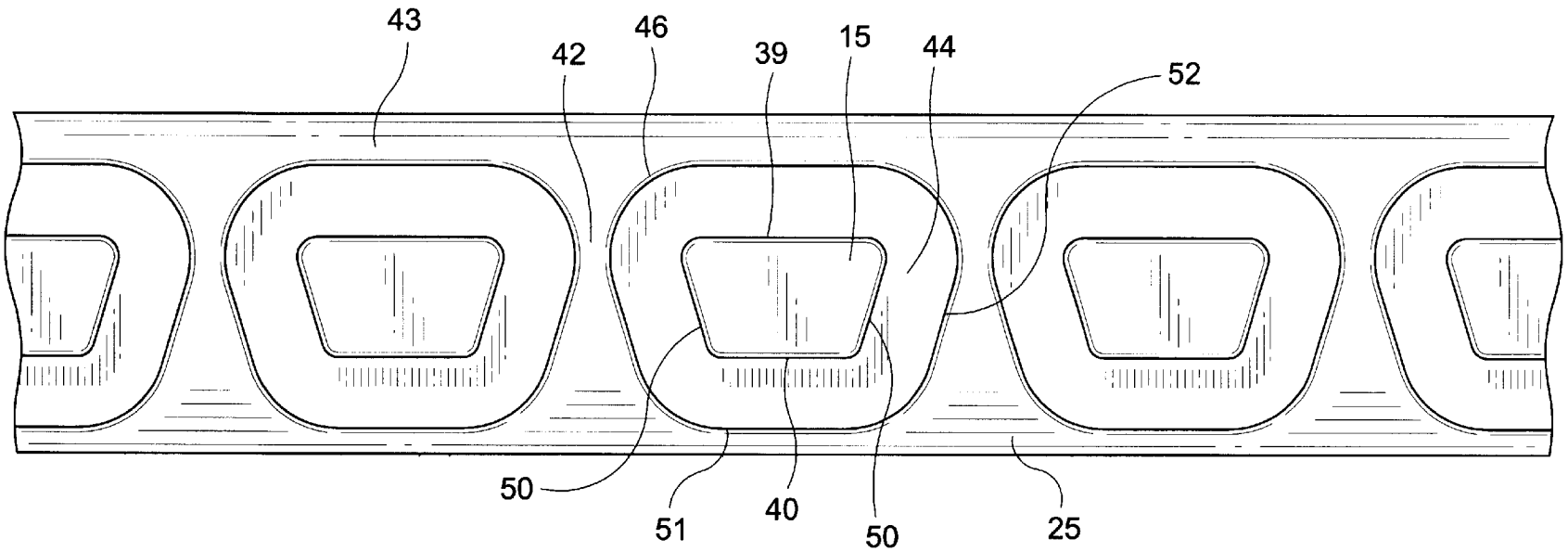
FIG. 6 is an enlarged top view of a portion of the skin-contacting element of the present invention

The preferred embodiment of the cavities and skin-engaging elements of the skin-contacting element are best illustrated in FIGS. 3–9. In this preferred embodiment, the skin-engaging elements comprise a series of projections 15 which extend upward within cavities 44, with a single projection contained within each cavity. The projections preferably are a geometric shape, such as a triangle, diamond, square or circle and more than one projection may be in each cavity. Most preferably, the projections are in the shape of a trapezoid, including a front wall 40, a top wall 41, two side walls 50 and back wall 39. In this preferred embodiment, the intersections of the side walls with the top wall and the front wall are slightly rounded, as shown in FIG. 6. The radius of curvature of these intersections may be in the range of about 0.05–0.5 mm, with a preferred radius of curvature of about 0.13 mm. In a preferred embodiment, each side wall of the trapezoid extends outward at an angle of about 0–60 degrees, and most preferably about 15 degrees, from a line perpendicular to the front wall of the projection. While the dimensions may vary, a preferred embodiment for the trapezoid projection provides for a distance of about 0.59 mm from the front wall to the back wall and about 1.0 mm at the widest point between the side walls. The preferred length of the front wall of the projection, as measured at the intersection of tangent lines drawn from the side walls and the front wall is in the range of about 0.67 mm. The preferred length of the back wall of the projection, as measured at the intersection of the tangent lines drawn from the side walls and the back wall is the range of about 0.91 mm.

Each cavity comprises top wall 45, side walls 52, front wall 51 and a floor 47, and each cavity is separated from the adjoining cavities by dividers 42. In the preferred embodiment, the side walls 52 of the cavities and dividers are gradually tapered upward from front to back until the side walls and dividers intersect with the back wall 43 of the skin-engaging element. The side walls of the cavities preferably extend outward at substantially the same angle as that of the side walls of the projections such that the side walls of the cavities are substantially parallel to the walls of the projections. The front wall 25 and the back wall 43 of the skin-engaging element are continuous and substantially parallel to the cutting edge of the blade or blades. In a preferred embodiment, the front wall 51 of the cavity is in the range of about 0.10–0.20 mm from the front of the front portion of the front wall 25 of the skin-engaging element, with a preferred distance of about 0.11–0.14 mm. Also in a preferred embodiment, the back wall 46 of the cavity is in the range of about 0.20–0.30 mm, from the back of the back wall of the skin-engaging element with a preferred distance of about 0.22–0.26 mm. Preferably, the distance from a wall of the projection to a wall of the cavity is about 0.2 mm. In order to allow the walls of the cavity to be substantially equidistant from the walls of the projection, the corners of the walls of the cavities are curved at a preferred radius of about 0.33 mm. In a preferred embodiment, tabs 38 extend outward from both ends of the skin-contacting element to facilitate attachment of the element to the razor cartridge.

Figure 7:
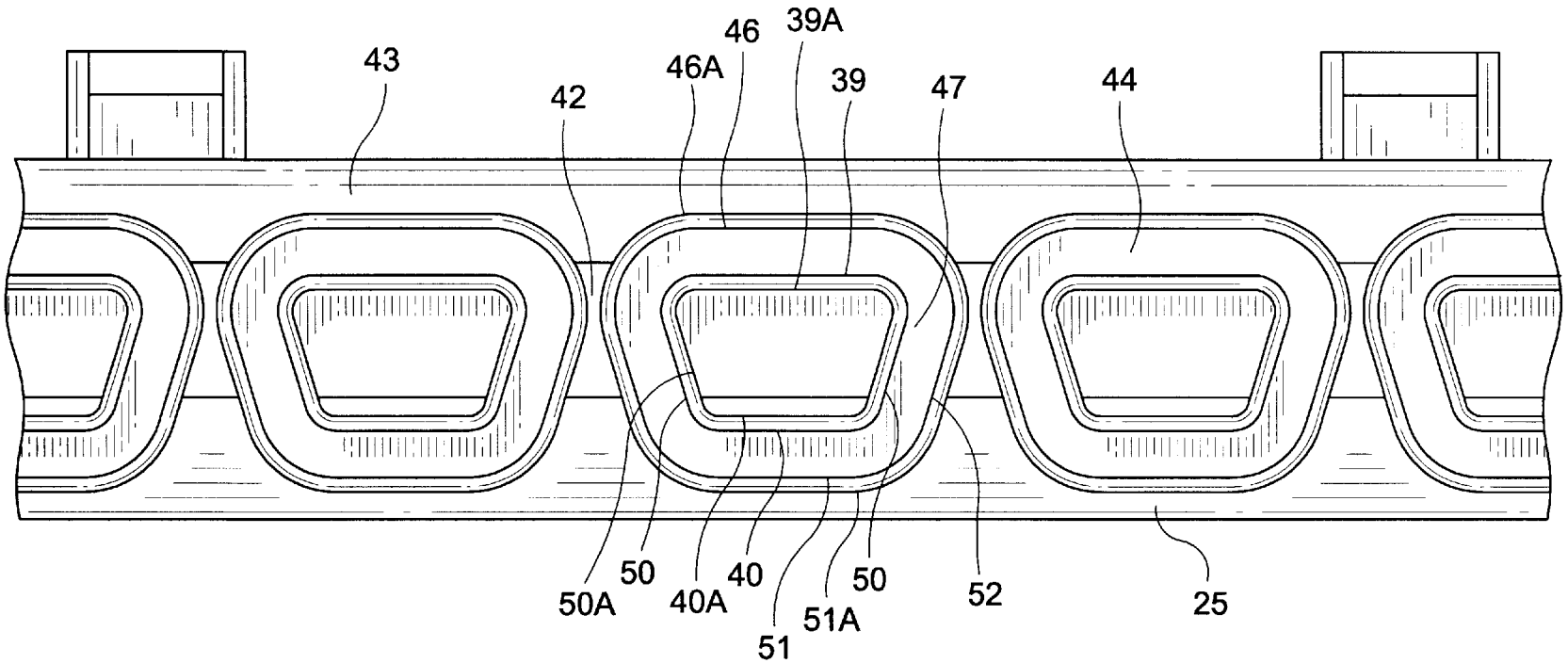
FIG. 7 is an enlarged top view of a portion of the skin-contacting element of the present invention having tapered protrusions.
Figure 8:
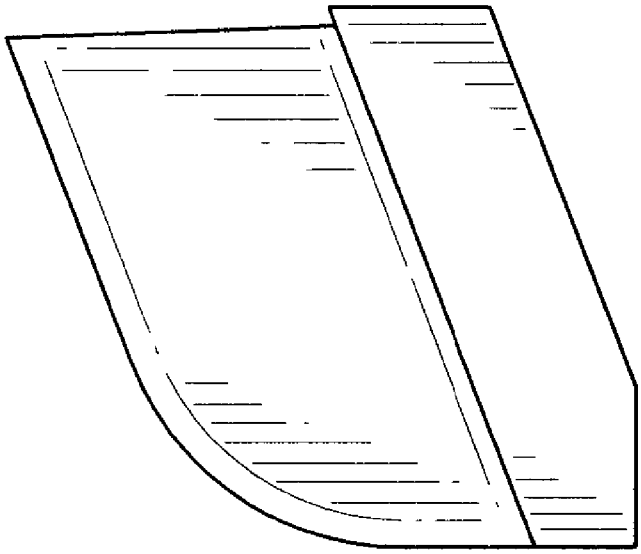
FIG. 8 is an end of the skin-contacting element of the present invention.
Figure 9:
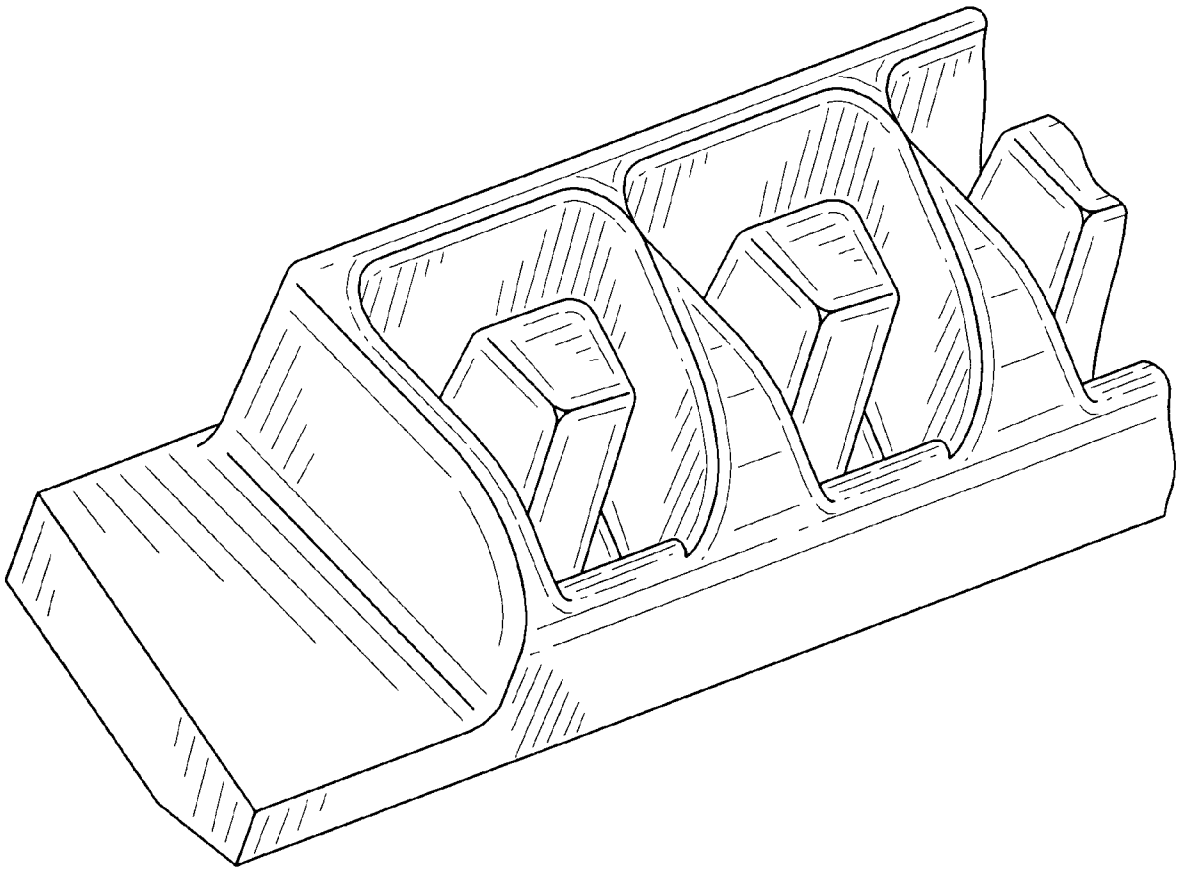
FIG. 9 is an exploded perspective view of a portion of the skin-contacting element of the present invention.

While the dimensions of the projections and cavities may vary, in the exemplary embodiment of FIGS. 3–9, the projections have a front wall height in the range of about 0.3–3.0 mm with a most preferred front wall height of about 0.86 mm. The projections have a back wall height in the range of about 0.3–3.0 mm with a preferred back wall height of about 1.05 mm. As illustrated in FIG. 7, the projections are preferably rounded or tapered inward near the top wall 41. This rounding may be either gradual over the entire length of the projection or concentrated in the top portion of the projection. Consequently, the width and length of the walls 39, 40 and 50 of the projection is slightly larger at the base of the projection, adjacent to the cavity floor 47, than the width and length of the walls 39A, 40A and 50A at the opposite end of the projection. While any amount of desired tapering may be utilized, a preferred taper would result in a reduction in the width and length of the projection at its uppermost point of about 0.05 mm in each direction from its width and length at the base.

As also illustrated in FIG. 7, the walls of the cavities may be rounded or tapered outward, away from the projections. This rounding or tapering may be gradual over the entire length of the walls of the cavity or may be concentrated in the top portion of the cavity wall. Consequently, the distance between the walls of the projection and the walls of the cavity would be slightly greater at the top of the cavity walls 46A, 50A and 51A than at the base of the cavity walls. In this preferred embodiment, the width of the dividers between each of the cavities would be in the range of about 0.10 mm at the closest point between cavities. While any amount of desired tapering may be utilized, a preferred taper would result in an increase in the distance between the walls of the cavity, at their uppermost points, of about 0.05 mm. While the height of the cavity side walls and the dividers may vary, in the preferred embodiment the cavity side walls and dividers taper upward until they are approximately the same height as the projections. Accordingly, the height of the front of the projections is greater than that of the corresponding section of the divider such that the projection extends upward above the divider at that point. To optimize the sensation to the user, the projections preferably extend above the dividers at the initial point of skin contact When the razor moves in the direction of shaving F, the trapezoidal projections gradually increase the tension on the skin as the skin approaches the blades. This tension on the skin acts to stretch the skin and produce a closer and more comfortable shave. The cavity acts as a reservoir for gathering and storing an appropriate amount of shaving cream and metering it out in a uniform manner so that an optimum amount of shaving cream is present on the skin at the point where the blades encounter the skin. This is in direct contrast to some currently available razor systems which have ridges that wipe away substantially all of the shaving cream prior to the arrival of the blades. The continuous rubber back wall of the skin-engaging element provides the added benefit of increasing the stretching of the skin just prior to the arrival of the seat blade. This further aids in improving the closeness and comfort of the shave. One additional advantage offered by the present invention is that the combination of projections and cavities provides a unique sensation to the user. The sensation may be varied as desired via a change in the arrangement, shape and sizes of the cavities and/or projections, as set forth in the further embodiments set forth below.

In alternative embodiments for the skin-contacting element the skin-contacting elements may have cavities which are circular in nature and have no separately defined side walls. The projections may be of virtually any desired shape, including square, triangular, rectangular, circular and/or any other desired geometric shape. Also, the skin-contacting elements may have projections with a height greater than or less than the heights of the side walls of the cavities and the dividers. In a further alternative, the heights of the projections may vary such that certain projections are higher than the dividers while certain projections are shorter than the dividers. Alternatively, the shape of the cavity may vary and the shape of the projections may be either constant or varied.

As shown in FIG. 2, preferably the cap 16 includes a recess 40 in which a shaving aid 21 is applied. As used herein, the term shaving aid refers equally to either a shave-aiding agent combined with a solid, water-soluble micro-encapsulating or micro-porous structure which retains the agent, or to that agent itself being a water-soluble solid.

Exemplary materials constituting shaving aid 21 may comprise one or various combinations of the following:

A. A lubricating agent for reducing the frictional forces between the razor and the skin, e.g., a micro-encapsulated silicon oil.

B. An agent which reduces the drag between the razor parts and the surface being shaved, e.g., a polyethylene oxide in the range of molecular weight between 100,000 and 6,000,000; a non-ionic polyacrylamide; and/or a natural polysaccharide derived from plant materials such as "guar gum".

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium larnyl sulphate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts H. Essential oils.

I. Vitamin E, e.g., in a formulation of vitamin E acetate, sodium pyruvate, and sunflower oil, contained on a polytrap bead carrier.

The configuration of shaving aid, its place of application to the razor cartridge, the manner of attachment and/or other means and method of incorporation may vary widely to fit particular requirements.

Microencapsulation has been developed to the extend that it may be used to controllably release a large variety of agents including various oils such as silicone oil. Additional information concerning the technology of microencapsulation may be obtained from "Microencapsulation", pages 420–437 in "The Theory & Practice of Industrial Pharmacy", Second Edition, 1970,1976, published by Lea & Febiger., which is incorporated herein by reference. Further, publication by Union Carbide Corporation of May 1977, entitled "Polyox, Water Soluble Resins: Forming Association Compounds" teaches at page 11, the use of polyethylene oxide for microencapsulating water-immiscible oils and, at page 17, the uses of gelatin and polyethylene oxide to form soluble films for microencapsulation applications, also incorporated by reference.

Another Union Carbide publication of May 1972, entitled "Polyox, Water Soluble Resins: Thermoplastic Processing: Calendering, Extrusion, and Injection Molding" discloses a basic process for injection molding items using polyethylene oxide. That publication also describes the formation of calendered films and sheets of polyethylene.

U.S. Pat. Nos. 3,075,033 and 3,181,973 provide examples of ways in which polyethylene oxide may be mixed with an insoluble thermoplastic (such as polystyrene of which cap 22 and seat 12 herein are often made) and then formed into a plasticized mass. The polyethylene oxide is then released from the mass by the application of water.

The aforementioned "The Theory & Practice of Industrial Pharmacy" in Chapters 10 and 11 entitled "Compaction & Compression" and "Tablets", respectively, pages 296–358, discloses a variety of compression and/or compaction techniques which, with binders, may be used to form tablets or bars of a large variety of materials.

The foregoing discloses techniques by which shave-aiding agents, such as silicone oil, may be microencapsulated in water soluble capsules. Such microcapsules may then be mixed with a cement or binder and adhered to an appropriate surface of a razor cartridge. Also disclosed are various techniques by which polyethylene oxide may be formed in a matrix with other materials, such as polystyrene, or formed into sheets or strips which may be adhered to an appropriate surface of a razor cartridge.

These embodiments of the invention have been selected only to exemplify basic approaches to applying the shaving aid in rod, strip or particle form. As is apparent, the shaving aid may be attached to an outer surface of a razor cartridge, recessed into the cartridge, formed as an integral part of one or more of the basic cartridge components (e.g., its guard bar or a spacer between blades in a twin-blade cartridge) and/or impregnated or dispersed in the material from which one or more of the blade-supporting cartridge components are molded or otherwise formed.

While there have been described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

We claim:

1. A shaving implement comprising:

at least one razor blade having a cutting edge extending in a direction;

a shaving head which secures the at least one razor blade, the shaving head being flexible in a direction perpendicular to the direction of the cutting edge; and the shaving head including a skin-contacting element having leading and trailing edges parallel to the cutting edge, wherein the skin-contacting element includes a flexible base secured to the shaving head and a plurality of skin-engaging members extending from the base, and wherein the skin-engaging members define a plurality of cavities and projections to meter the amount of shaving cream on the surface being shaved.

2. A shaving implement according to claim 1, further comprising a guard portion lying forward of the cutting edge, the guard portion including the skin-contacting element.

3. A shaving implement according to claim 2, wherein the skin-contacting element is insert molded onto the guard portion.

4. A shaving implement according to claim 2, wherein the skin-contacting element is formed of a material that will chemically bond with the shaving head.

5. A shaving implement comprising:

at least one razor blade having a cutting edge; and a shaving head which secures the at least one razor blade; wherein the shaving head includes a skin-engaging element having a plurality of cavities, wherein at least one projection extends upward within at least one of the plurality of cavities.

6. A shaving implement according to claim 5, wherein the at least one projection comprises a plurality of projections wherein each extends upward in each of the plurality of cavities.

7. A shaving implement according to claim 6, wherein each of the plurality of cavities comprise four walls and a floor.

8. A shaving implement according to claim 7, wherein the plurality of cavities are separated by dividers.

9. A shaving implement according to claim 8, wherein the skin-engaging element is comprised of an elastomeric material.

10. A shaving implement according to claim 9, wherein the elastomeric material has a durometer (Shore A scale) between 30 and 90.

11. A shaving implement according to claim 10, wherein the elastomeric material has a durometer (Shore A scale) of about 45.

12. A shaving implement according to claim 9, wherein at least one of the projections is in the form of a geometric shape.

13. A shaving implement according to claim 12, wherein the shaving head further comprises a shaving aid for laying down a lubricating film when used for wet shaving.

14. A shaving implement according to claim 12, wherein at least one of the projections is circular in shape.

15. A shaving implement according to claim 12, wherein at least one of the projections is triangular in shape.

16. A shaving implement according to claim 12, wherein at least one of the projections is square in shape.

17. A shaving implement according to claim 12, wherein at least one of the projections is rectangular in shape.

18. A shaving implement according to claim 12, wherein each of the projections is in the shape of a trapezoid having a front wall, a back wall, two side walls, a base and a top wall.

19. A shaving implement according to claim 18, wherein each of the plurality of cavities is in the shape of a trapezoid.

20. A shaving implement according to claim 19, wherein the back wall of each of the projections has a length in the range of about 1.0 mm.

21. A shaving implement according to claim 19, wherein a gap in the range of about 0.1–0.2 mm exists between the front, back and side walls of the projections and the walls of the cavities.

22. A shaving implement according to claim 18, wherein the front wall of each of the projections has a length in the range of about 0.3–3.0 mm.

23. A shaving implement according to claim 18, wherein the front wall of each of the projections has a length in the range of about 0.67 mm.

24. A shaving implement according to claim 18, wherein the back wall of each of the projections has a length in the range of about 0.5–3.0 mm.

25. A shaving implement according to claim 18, wherein the two side walls of each of the projections have a length in the range of about 0.3–3.0 mm.

26. A shaving implement according to claim 18, wherein the intersections of the two side walls, the back wall and the front wall of the projections with the top wall of the projections are rounded.

27. A shaving implement according to claim 5, wherein the cavities meter shaving cream such that an effective amount is deposited on the surface being shaved.

28. A shaving implement according to claim 27, wherein the cavities and projections are such that the cavities and projections provide a unique sensation to the user during shaving.

29. A shaving implement according to claim 5, wherein at least one of the cavities is circular in shape.

30. A shaving implement according to claim 5, wherein at least one of the cavities is triangular in shape.

31. A shaving implement according to claim 5, wherein at least one of the cavities is square in shape.

32. A shaving implement according to claim 5, wherein at least one of the cavities is rectangular in shape.

* * * * *